US008240256B2

(12) United States Patent
Nutt

(10) Patent No.: US 8,240,256 B2
(45) Date of Patent: Aug. 14, 2012

(54) GONDOLA RAIL CAR WITH TUB FLOOR

(75) Inventor: Bryan M. Nutt, Duncan, SC (US)

(73) Assignee: Progress Rail Services Corp, Albertville, AL (US)

( * ) Notice: Subject to any disclaimer, the term of this patent is extended or adjusted under 35 U.S.C. 154(b) by 258 days.

(21) Appl. No.: 12/609,007

(22) Filed: Oct. 29, 2009

(65) Prior Publication Data

US 2010/0101447 A1 Apr. 29, 2010

Related U.S. Application Data

(60) Provisional application No. 61/109,479, filed on Oct. 29, 2008.

(51) Int. Cl.
*B61D 17/00* (2006.01)

(52) U.S. Cl. ..... 105/406.1; 105/404; 105/239; 105/244

(58) Field of Classification Search ..... 105/239, 105/244, 355, 404, 406.1
See application file for complete search history.

(56) References Cited

U.S. PATENT DOCUMENTS 4,254,714 A * 3/1981 Heap ..... 105/406.1
4,361,097 A * 11/1982 Jones et al. ..... 105/406.1
5,178,074 A * 1/1993 Fetterman et al. ..... 105/406.1
5,216,958 A * 6/1993 Kurtz ..... 105/247
5,341,747 A * 8/1994 Fetterman et al. ..... 105/406.1
5,367,958 A * 11/1994 Weiss et al. ..... 105/406.1
5,373,792 A * 12/1994 Pileggi et al. ..... 105/406.1
5,443,016 A * 8/1995 Erickson ..... 105/411
5,458,067 A * 10/1995 Weiss et al. ..... 105/406.1
5,488,912 A * 2/1996 Pileggi et al. ..... 105/422
5,727,475 A * 3/1998 Kurtz ..... 105/406.1
5,813,353 A * 9/1998 Sauter ..... 105/406.1
6,138,581 A * 10/2000 Smith et al. ..... 105/406.1
6,148,735 A * 11/2000 Sauter et al. ..... 105/406.1
6,330,863 B1 * 12/2001 Lydic et al. ..... 105/355
7,424,854 B2 * 9/2008 Forbes ..... 105/355
2010/0011987 A1 * 1/2010 Forbes ..... 105/406.1
2010/0101447 A1 * 4/2010 Nutt ..... 105/406.1

* cited by examiner

*Primary Examiner* — Mark Le
*Assistant Examiner* — Jason C Smith
(74) *Attorney, Agent, or Firm* — Finnegan, Henderson, Farabow, Garrett & Dunner LLP; Andrew J. Ririe

(57) ABSTRACT

A rail car with a double longitudinal tub floor. The car may comprise a car body supported on a frame, the principal element of the frame being a longitudinal center sill assembly. The frame is in turn supported on a pair of wheel trucks. The car body includes a pair of generally vertical end wall assemblies joined to a pair of generally vertical side assemblies. The box is closed on the bottom by a floor assembly. The floor assembly includes a pair of longitudinal tubs. The longitudinal tubs are divided into tub segments and supported by cross-bearer assemblies. The cross-bearer assemblies are joined to the center sill assembly. The longitudinal tubs are supported primarily by the center sill assembly, both directly by joining each tub's lateral inboard edge to the center sill, and indirectly by joining the tub's chord end edges to the cross-bearer assemblies. Diagonal braces may be attached to the cross bearer assemblies and the side assemblies to help prevent bowing of the sides.

17 Claims, 5 Drawing Sheets

GONDOLA RAIL CAR WITH TUB FLOOR

This application claims priority to U.S. provisional patent application No. 61/109,479 filed Oct. 29, 2008.

TECHNICAL FIELD

The field of this invention is rail cars, and more particularly the manner in which tub floors are attached to and supported on rail cars.

BACKGROUND

Gondola rail cars are characterized by design simplicity and efficiency in construction and operation. They feature a car body defining a generally rectangular box for holding cargo with side walls, end walls, and a bottom. The car body is supported on a frame which in turn is supported on pair of wheel trucks with wheels that ride on railroad rails. The cargo can be loaded and unloaded from an open top of the car body. Gondola cars are sometimes designed for rotary dump, where the entire car is held onto a rotary dump mechanism which turns the car about an axis parallel to the car's longitudinal axis, until reaching an almost inverted position, to empty the cargo.

Many thousands of gondola rail cars are in operation on railroads around the world, transporting bulk commodities such as coal, ore, aggregates, etc. Over time, design modifications and improvements have resulted in rail cars with increased efficiency and durability. Improvements which are modest when viewed in the context of an individual rail car, can nevertheless have a large overall financial and environmental impact because of the wide spread and intensive use of these rail cars.

Many years ago gondola rail cars were introduced with a unique bottom floor structure that helped increase the car's capacity and lower its center of gravity. Instead of a flat bottom floor mounted on top of a center sill, two longitudinal arcuate tubs were attached to and suspended between the center sill and side walls. An example of this design can be seen in U.S. Pat. No. 4,361,097, issued on Nov. 30, 1982 (hereinafter the '097 patent). Coal gondola cars using this design have been built and sold by FreightCar America and its predecessor companies under the BethGon® brand name. This patent application proposes modifications and improvements to the double longitudinal tub floor design and similar designs to continue to enhance efficiency, reliability, and durability.

SUMMARY OF THE INVENTION

A rail car may comprise a car body defining a box for holding cargo, the car body including a pair of side assemblies spaced apart on opposite sides of the car body and a pair of end wall assemblies spaced apart on opposite sides of the car body, a frame including a center sill assembly running in the longitudinal direction of the rail car and spanning approximately from one end wall assembly to the other end wall assembly, the car body supported on the frame, a pair of truck assemblies with wheels, the frame supported on the truck assemblies, a pair of longitudinal tubs each one attached near its inboard edge to the center sill assembly and attached near its outboard edge to a respective one of the side assemblies, and at least one cross-bearer assembly attached at each end thereof to one of the side assemblies and attached at its center to the center sill assembly, the cross-bearer assembly dividing each of the longitudinal tubs into tub sections, with each tub section attached at one of its chord end edges to the cross-bearer assembly.

DETAILED DESCRIPTION

Figure 1:
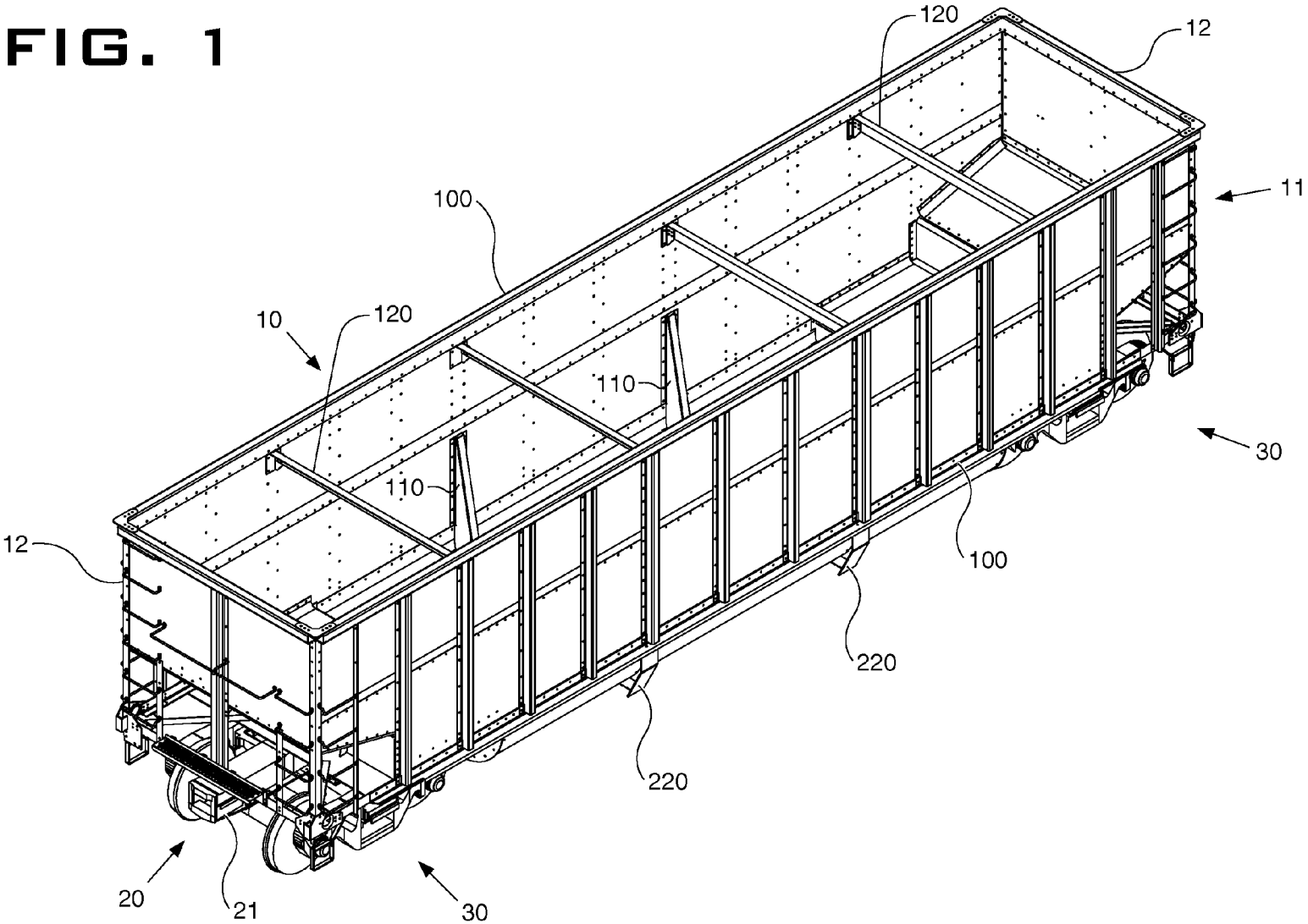
FIG. 1 is an isometric view of a coal gondola rail car designed according to the principles of the present invention.

The following is a detailed description of exemplary embodiments of the invention. The exemplary embodiments described herein and illustrated in the drawing figures are intended to teach the principles of the invention, enabling those of ordinary skill in this art to make and use the invention in different environments and for many different applications. The exemplary embodiments should not be considered as a limiting description of the scope of patent protection. The scope of patent protection shall be defined by the appended claims, and is intended to be broader than the specific exemplary embodiments described herein.

While the double longitudinal tub design has increased capacity and efficiency, some problems have been identified. In the design shown in the '097 patent and in other commercialized designs for double longitudinal tub floors, the outboard lateral edge of the tub is suspended from the side wall. As a result, the side wall bears a large load from the weight of the cargo in the rail car. This makes effective maintenance of the side wall material, braces, and fasteners important as rust or other wear or failure of these materials or components will degrade the ability of the side wall to support this load. Extensive repairs have sometimes been necessary on older rail cars to repair this portion of the car body.

FIGS. 1-8 illustrate a proposed novel rail car design in which the double longitudinal tub floor is supported more fully from the center sill, and is less dependent upon support from the side walls. The rail car illustrated herein is especially adapted for a coal-carrying gondola car. But these principles may also be applied to other gondola cars, or to hopper cars, or to other types of rail cars generally.

Figure 2:
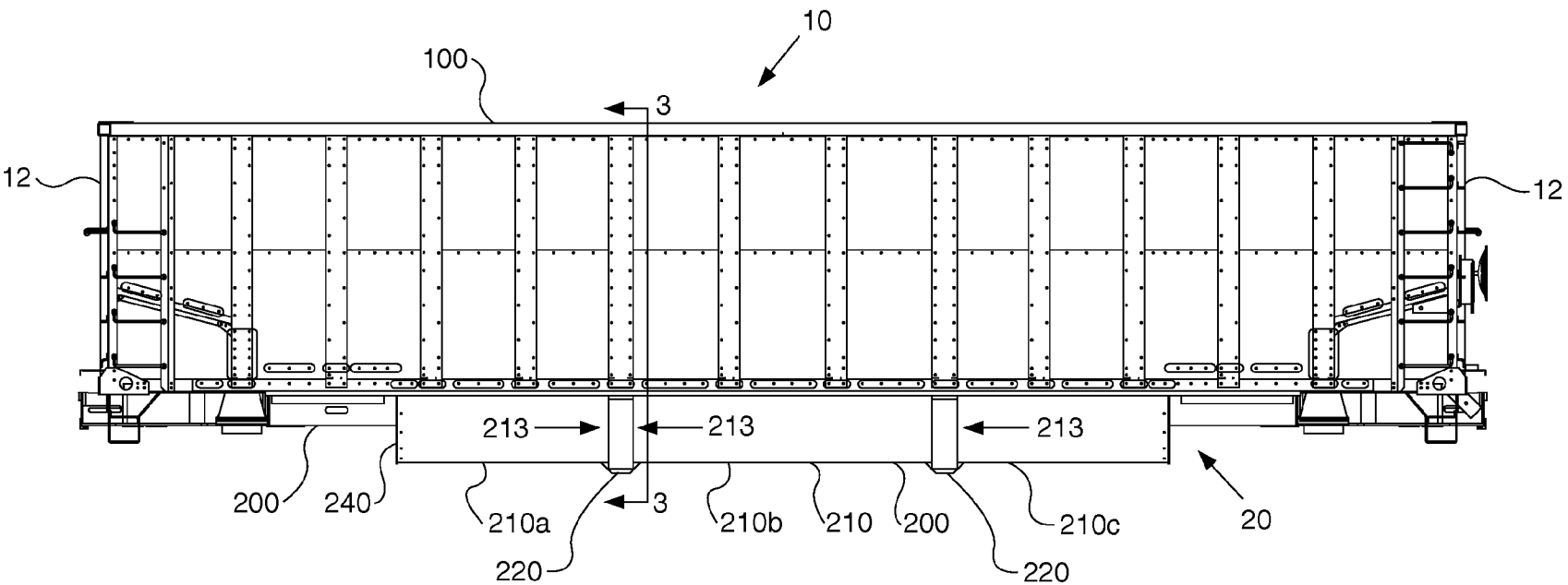
FIG. 2 is a side view of the rail car of FIG. 1.

With reference first to FIGS. 1 and 2 for a general picture of the rail car layout, a car body 10 defines a generally rectangularly-shaped box 11 for holding cargo. The car body is supported on a frame 20, the principal element of which is a center sill assembly 21. The frame 20 is in turn supported on a pair of wheel trucks 30 in a known manner.

The car body 10 includes a pair of generally vertical end wall assemblies 12, which span the lateral dimension of the car body 10, joined to a pair of generally vertical side assemblies 100, which span the longitudinal dimension. The box 11 is closed on the bottom by a floor assembly 200 to form a five-sided container for holding the cargo. The floor assembly 200 includes a pair of longitudinally-oriented tubs 210.

Figure 3:
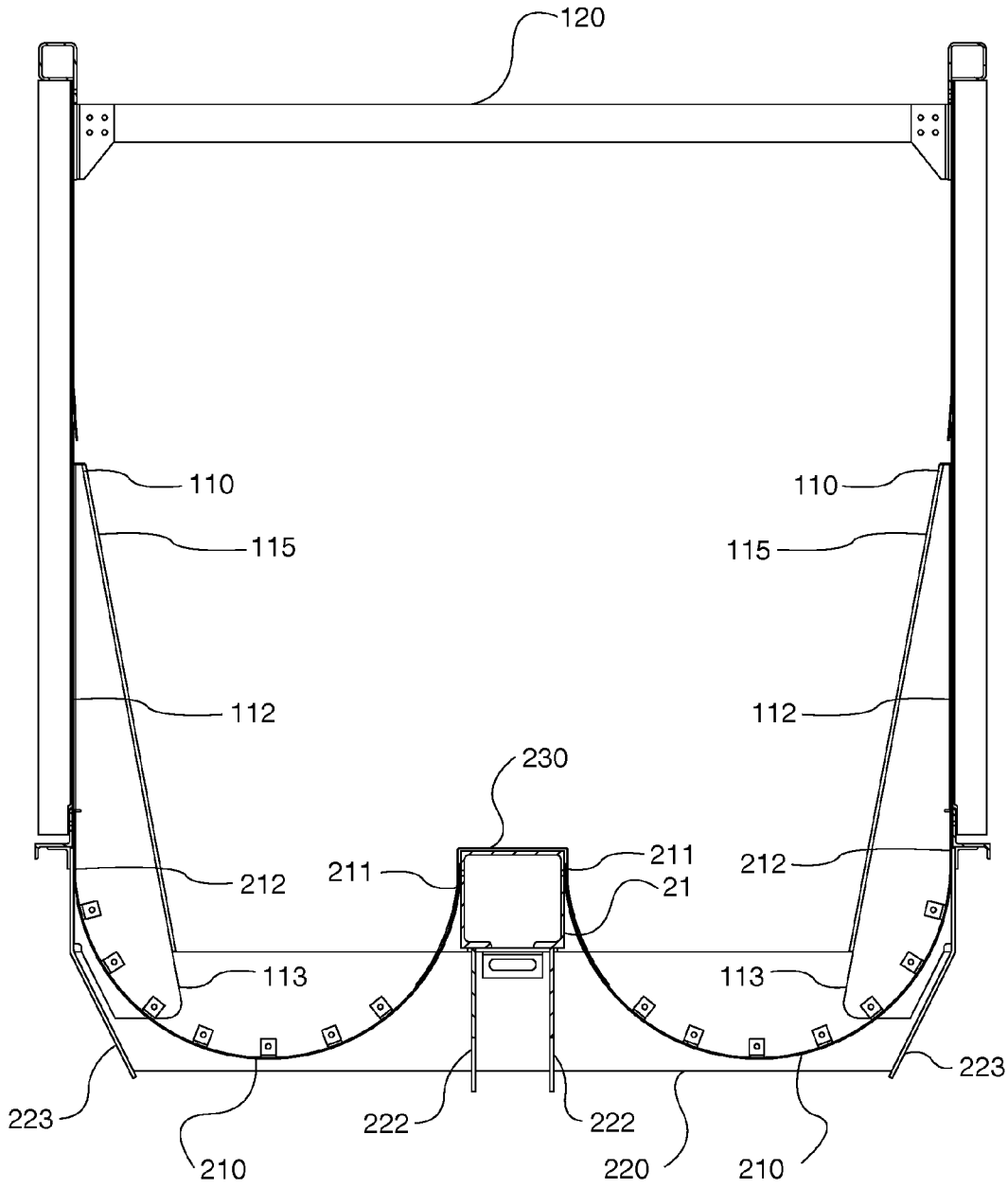
FIG. 3 is a sectional view taken along section plane 3-3 in FIG. 2 which shows the double longitudinal tub floor and its support structure.

FIG. 3 is a sectional view taken from sectional plane 3-3 in FIG. 2 and illustrates the general layout of the floor assembly 200. The center sill assembly 21 is the structural "backbone" of the rail car and runs in the longitudinal direction from end to end. A coupler may be attached at each end of the center sill assembly 21 to couple to other rail cars and transfer loads through the center sill assembly 21 between cars.

Two longitudinal tubs 210 extend between the center sill assembly 21 and one of the side assemblies 100. Between the center sill assembly 21 and the side assembly 100 each longitudinal tub has a curved section which is concave toward the inside of box 11. Each of the two longitudinal tubs 210 has a lateral inboard edge 211 and a lateral outboard edge 212. Each inboard edge 211 is attached to the center sill assembly 21 in a known manner via, for example, mechanical fasteners or welding or both. The inboard edges 211 may attach to a vertical side surface of the center sill assembly 21, or to the horizontal top surface, as desired. A portion of the weight of the cargo bearing on longitudinal tubs 210 is accordingly directly supported by the center sill assembly 21.

A separate longitudinal hood 230 can be mounted to the horizontal top surface of the center sill assembly 21 to protect it from wear. The longitudinal hood 230 is preferably attached to the center sill assembly 21 after the longitudinal tubs 210 are attached, so that the longitudinal hood 230 can partially overlap and protect the inboard edges 211. The longitudinal hood could be formed from sheet stock by bending two lateral downwardly-extending edge sections on each side of a top section, so that the edge sections will partially overlap the vertical side surfaces of the center sill when installed.

In addition to direct support from the center sill assembly 21, the longitudinal tubs are further supported by lateral cross-bearer assemblies 220. In the illustrated design, two cross-bearer assemblies 220 are used, longitudinally spaced from one another. But those of ordinary skill in this art will be able to adapt for a single cross-bearer assembly or more than two cross-bearer assemblies, which may be more appropriate for some applications.

Figure 4:
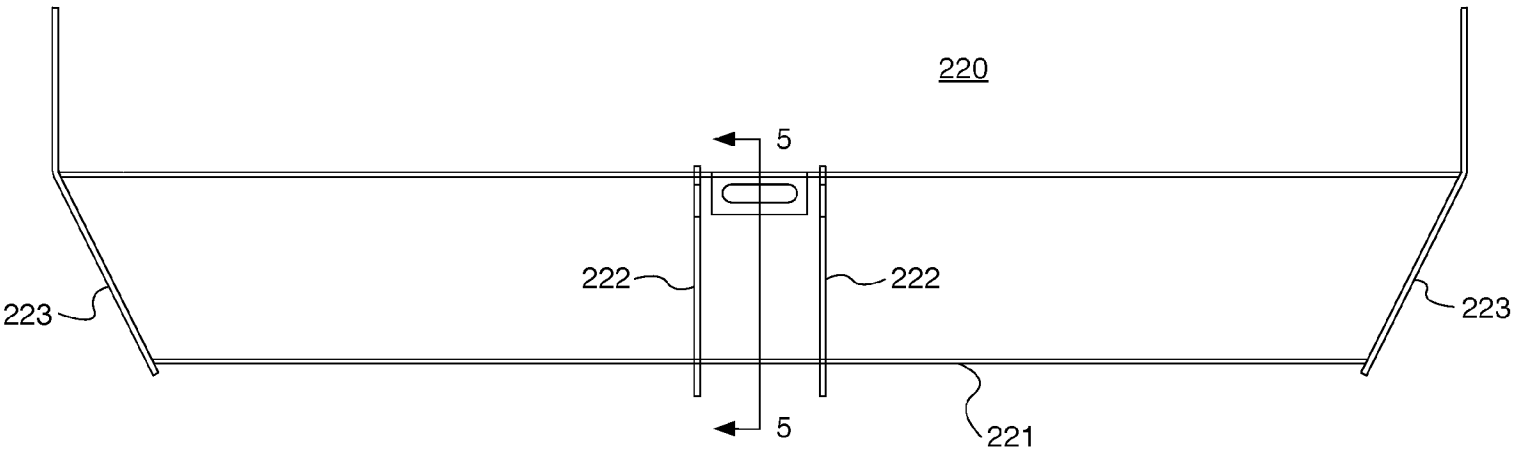
FIG. 4 is a front view of a cross-bearer assembly shown in FIG. 3 which helps support the longitudinal tub.
Figure 5:
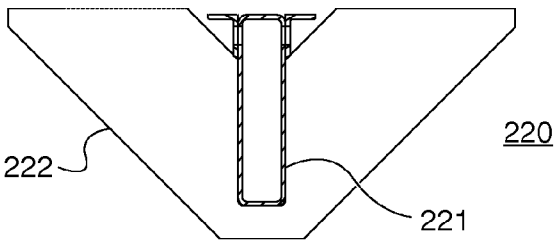
FIG. 5 is a sectional view of the cross-bearer assembly taken from section plane 5-5 in FIG. 4.

FIGS. 4 and 5 provide more detailed illustrations of each cross-bearer assembly 220. The cross-bearer assembly 220 includes a lateral cross-bearer 221 in the form of a tube. It may also be possible to form this cross-bearer 221 as a plate or other structure, but a tube can provide advantageous rigidity while minimizing material. A pair of gussets 222 are joined to and positioned normal to the cross-bearer 221 and near its center. More than two or less than two gussets 222 are, of course, also possible. Gussets 222 can be joined to the cross-bearer 221 via welding or other attachment methods. Each outboard end of cross-bearer 221 is joined to a side attachment plate 223. Side attachment plate 223 provides a generally vertical leg for attaching the cross-bearer assembly 220 to the side assemblies 100.

Cross-bearer assembly 220 is directly supported by the center sill assembly 21 through joining cross-bearer 221 and gussets 222 directly to the underside of center sill assembly 21, as shown in FIG. 3. Joining the cross-bearer assembly 220 to the center sill assembly 21 can be done via welding or mechanical fasteners, and may be assisted through the use of braces and brackets and the like. The cross-member assembly 220 is, therefore, suspended near its center underneath the center sill assembly 21, and able to transfer any loads supported by it to the center sill assembly 21.

Each longitudinal tub 210 is, in turn, directly supported by the cross-bearer assemblies 220. The two cross-bearer assemblies 220 in this illustrated design divide each longitudinal tub 210 into three approximately equal length tub sections, 210*a*, 210*b*, and 210*c*. Tub sections 210*a*, 210*b*, 210*c* may be completely separate from one another, or there may be a portion of each section which is integrally formed with or joined to another section. The tub sections 210*a*, 210*b*, and 210*c* are each directly joined to at least one cross-bearer assembly 220, and the middle tub section 210*b* is joined to two cross-bearer assemblies 220. Tub sections 210*a* and 210*c* are also joined to end plates 240 (see FIG. 2) in a known manner to both close the tubs 210 to seal them, and to support them.

As shown in FIG. 3, the cross-bearer assembly 210 overlaps a large portion of the profile of the longitudinal tubs 210, providing a generally vertical end surface to which chord end edges 213 of the tub 210 may be joined. In other words, the portion of the chord end edge 213 that abuts cross-bearer 221 is a chord, whose chord length is a large percentage of the overall chord length of the curved section of longitudinal tub 210. Stated yet another way, the portion of the chord end edge 213 which abuts cross-bearer 221 spans preferably at least between 90 to 150 degrees, a large portion of the overall curvature of the longitudinal tub which is generally about 180 degrees. Joining the chord end edges 213 to the cross-bearers 221 can be done through welding or mechanical fasteners, or both, and may benefit from the use of braces and bracket hardware such as those illustrated in FIG. 3.

With the construction just described, longitudinal tubs 210 are primarily structurally supported by the center sill assembly 21, through a direct connection to the center sill assembly 21 at inboard edges 211, and through an indirect connection at the chord end edges 213 to cross-bearer assembly 220 which in turn hangs underneath and is supported by the center sill assembly 21. This relieves much of the structural support of longitudinal tubs 210 that was born by the side assemblies 100 in previous designs.

Figure 6:
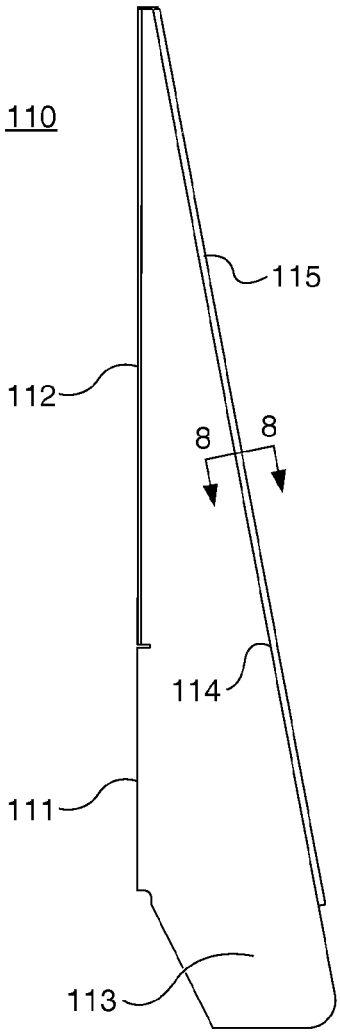
FIG. 6 is a side view of the diagonal brace shown in FIG. 3.
Figure 7:
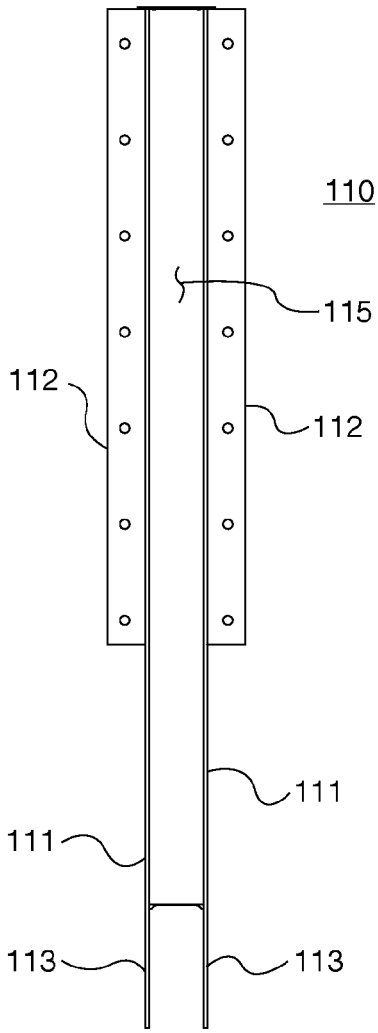
FIG. 7 is a front view of the diagonal brace shown in FIG. 3.
Figure 8:
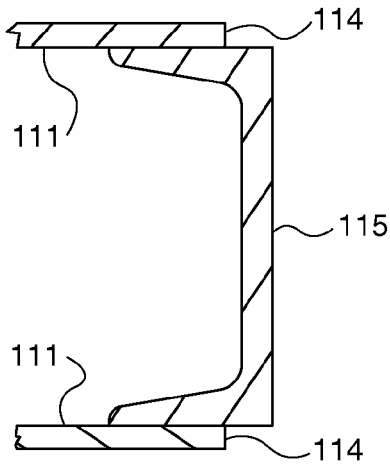
FIG. 8 is a sectional view taken from section plane 8-8 in FIG. 6.

This construction also facilitates the use of a novel diagonal brace assembly 110, best seen in FIGS. 6-8. In the illustrated design, there are four diagonal brace assemblies 110, one corresponding to each outboard end of a cross-bearer assembly 220. Each diagonal brace assembly 110 may include a pair of generally vertical diagonal brace plates 111. Each diagonal brace plate 111 may include a mounting flange 112. Mounting flange 112 is also generally vertical, but is also parallel to the side assembly 100, while the remainder of diagonal brace plate 111 is normal to the side assembly 100. The mounting flange 112 is for the convenience of attaching the diagonal brace plate 111 to the side assembly 100. Diagonal brace plate 111 also includes a lower overlap portion 113 which overlaps and attaches to the cross bearer 221. FIG. 7 illustrates the two overlap portions 113 in profile view. When finally assembled, the cross bearer 221 will fit in the open space shown in FIG. 7 between the two overlap portions 113. FIG. 3 also illustrates the overlap and attachment of overlap portions 113 to the cross bearer 221. The chord end edges 213 of the longitudinal tubs 210 are attached to the diagonal brace plates 111 at the overlap portions 113, in addition to being attached to the cross-bearer 221. Diagonal edges 114 of two diagonal brace plates 111 are joined via a brace channel 115 to form the diagonal brace assembly 110 in a tube like structure. Diagonal edges extend diagonally between the side assemblies 100 to the cross-bearer assemblies 220.

The diagonal brace assembly 110 provides structural support to side assembly 100, preventing it from bowing outward from the force of the weight of the cargo, and also helping it from bowing inward during rotary dumping. A top horizontal brace 120 (see FIG. 3) also spans from the side assembly 100 on one side of the rail car to the side assembly 100 on the other side to prevent inward and outward bowing of the side assemblies. In the illustrated design, at least four top horizontal braces 120 are provided.

INDUSTRIAL APPLICABILITY

A rail car according to the principles of the present invention has industrial applicability in the commercial transportation of bulk cargo such as coal, ore, aggregates, etc.

I claim:

1. A rail car comprising:

a car body defining a box for holding cargo, the car body including a pair of side assemblies spaced apart on opposite sides of the car body and a pair of end wall assemblies spaced apart on opposite sides of the car body;

a frame including a center sill assembly running in the longitudinal direction of the rail car and spanning approximately from one end wall assembly to the other end wall assembly, the car body supported on the frame;

a pair of truck assemblies with wheels, the frame supported on the truck assemblies;

a pair of longitudinal tubs each one attached near its inboard edge to the center sill assembly and attached near its outboard edge to a respective one of the side assemblies;

at least one cross-bearer assembly attached at each end thereof to one of the side assemblies and attached at its center to the center sill assembly, the cross-bearer assembly dividing each of the longitudinal tubs into tub sections, with each tub section attached at one of its chord end edges to the cross-bearer assembly; and a diagonal brace assembly including a pair of spaced apart diagonal brace plates, each diagonal brace plate including an overlap portion continuously joined to opposite sides of the cross-bearer assembly, and each diagonal brace plate also joined to a side assembly.

2. A rail car according to claim 1 wherein the at least one cross-bearer assembly comprises two cross-bearer assemblies which divide the two longitudinal tubs into three approximately equal length tub sections.

3. A rail car according to claim 2 wherein the each longitudinal tub is divided into three tub sections including a center tub section supported at each of its chord end edges to a cross-bearer assembly, and two tub sections which have one chord end edge supported on an end plate.

4. A rail car according to claim 1 wherein the at least one cross-bearer assembly comprises a cross-bearer and a plurality of gussets joined to the center of the cross-bearer and normal to the cross-bearer.

5. A rail car according to claim 1 wherein the diagonal brace assembly includes a diagonal edge extending between the side assembly and the at least one cross-bearer assembly.

6. A rail car according to claim 1 wherein each diagonal brace plate includes a mounting flange that is generally vertical and parallel to the side assembly.

7. A rail car comprising:

a car body defining a box for holding cargo, the car body including a pair of side assemblies spaced apart on opposite sides of the car body and a pair of end wall assemblies spaced apart on opposite sides of the car body;

a frame including a center sill assembly running in the longitudinal direction of the rail car and spanning approximately from one end wall assembly to the other end wall assembly, the car body supported on the frame;

a pair of truck assemblies with wheels, the frame supported on the truck assemblies;

a pair of longitudinal tubs each one attached near its inboard edge to the center sill assembly and attached near its outboard edge to a respective one of the side assemblies;

at least one cross-bearer assembly attached at each end thereof to one of the side assemblies and attached at its center to the center sill assembly, the cross-bearer assembly dividing each of the longitudinal tubs into tub sections, with each tub section attached at one of its chord end edges to the cross-bearer assembly; and a diagonal brace assembly including a pair of spaced apart diagonal brace plates, each diagonal brace plate including an overlap portion continuously joined to opposite sides of the cross-bearer assembly, and each diagonal brace plate also joined to a side assembly, the diagonal brace assembly including a diagonal edge extending between the side assembly and the at least one cross-bearer assembly.

8. A rail car according to claim 7 wherein the at least one cross-bearer assembly comprises two cross-bearer assemblies which divide the two longitudinal tubs into three approximately equal length tub sections.

9. A rail car according to claim 8 wherein the each longitudinal tub is divided into three tub sections including a center tub section supported at each of its chord end edges to a cross-bearer assembly, and two tub sections which have one chord end edge supported on an end plate.

10. A rail car according to claim 7 wherein the at least one cross-bearer assembly comprises a cross-bearer and a plurality of gussets joined to the center of the cross-bearer and normal to the cross-bearer.

11. A rail car according to claim 7 wherein each diagonal brace plate includes a mounting flange that is generally vertical and parallel to the side assembly.

12. A rail car comprising:

a car body defining a box for holding cargo, the car body including a pair of side assemblies spaced apart on opposite sides of the car body and a pair of end wall assemblies spaced apart on opposite sides of the car body;

a frame including a center sill assembly running in the longitudinal direction of the rail car and spanning approximately from one end wall assembly to the other end wall assembly, the car body supported on the frame;

a pair of truck assemblies with wheels, the frame supported on the truck assemblies;

a pair of longitudinal tubs each one attached near its inboard edge to the center sill assembly and attached near its outboard edge to a respective one of the side assemblies;

at least one cross-bearer assembly attached at each end thereof to one of the side assemblies and attached at its center to the center sill assembly, the cross-bearer assembly suspended near its center underneath the center sill assembly and dividing each of the longitudinal tubs into tub sections, with each tub section attached at one of its chord end edges to the cross-bearer assembly; and a diagonal brace assembly including a pair of spaced apart diagonal brace plates, each diagonal brace plate including an overlap portion continuously joined to opposite sides of the cross-bearer assembly, and each diagonal brace plate also joined to a side assembly.

13. A rail car according to claim 12 wherein the at least one cross-bearer assembly comprises two cross-bearer assemblies which divide the two longitudinal tubs into three approximately equal length tub sections.

14. A rail car according to claim 13 wherein the each longitudinal tub is divided into three tub sections including a center tub section supported at each of its chord end edges to a cross-bearer assembly, and two tub sections which have one chord end edge supported on an end plate.

15. A rail car according to claim 12 wherein the at least one cross-bearer assembly comprises a cross-bearer and a plurality of gussets joined to the center of the cross-bearer and normal to the cross-bearer.

16. A rail car according to claim 12 wherein the diagonal brace assembly includes a diagonal edge extending between the side assembly and the at least one cross-bearer assembly.

17. A rail car according to claim 12 wherein each diagonal brace plate includes a mounting flange that is generally vertical and parallel to the side assembly.

* * * * *